United States Patent [19]

Gentry

[11] Patent Number: 5,022,129

[45] Date of Patent: Jun. 11, 1991

[54] CRANKSHAFT-FORMING APPARATUS AND METHOD

[76] Inventor: Elvin O. Gentry, 1419 Towanda Street, Bloomington, Ill. 61701

[21] Appl. No.: 412,045

[22] Filed: Sep. 25, 1989

[51] Int. Cl.[5] ..... B21K 1/08; B21D 17/02

[52] U.S. Cl. ..... 29/6.01; 29/888.08; 72/384; 72/389; 72/404

[58] Field of Search ..... 29/6, 402.19, 402.21, 29/888.08, 6.01; 72/305, 306, 308, 311, 364, 377, 384, 385, 389, 399, 404, 406, 416, 473, 482; 269/225, 228, 258

[56] References Cited

U.S. PATENT DOCUMENTS

| | | | |
|---|---|---|---|
| 2,534,613 | 12/1950 | Meley | 29/6 |
| 4,030,172 | 6/1977 | Gentry | 29/6 |
| 4,736,612 | 4/1988 | Russell | 72/482 |

*Primary Examiner*—Joseph M. Gorski

*Assistant Examiner*—S. T. Hughes

*Attorney, Agent, or Firm*—Fitch, Even, Tabin & Flannery

[57] ABSTRACT

Disclosed is a crankshaft forming apparatus and method which has forming heads for forming throw sections at any angle 360° about the rotational axis of the crankshaft and orienting the full length of the throw sections of the crankshaft. The throws are checked for parallelism to the rotational axis of the crankshaft. By turning suitable actuators such as screws, the forming heads are pivoted about a vertical and/or horizontal axis to adjust the throw formation relative to the longitudinal axis. In this manner, each forming head may be adjusted in position until all of the respective throws being formed are parallel to the rotational axis of the crankshaft. Also provided is a toggle mechanism which clamps tightly a rod being formed and opens and closes the clamping units for insertion and removal of the rod.

12 Claims, 5 Drawing Sheets

CRANKSHAFT-FORMING APPARATUS AND METHOD

BACKGROUND OF THE INVENTION

1. Field of the Invention

This invention relates to an apparatus and a method for making multi-throw crankshafts, and more particularly, to method and apparatus for heating of metal rod stock to a forming temperature, and then bending the heated rod at desired locations along its length, in different directions, to form a plurality of parallel throws.

2. Description of Related Art

It is known in the prior art to form multiple-throw crankshafts by forging operations wherein rod or bar stock is heated and bent to form the throws. U.S. Pat. Nos. 2,555,695 and 2,676,229 disclose apparatus for electrically heating bar stock and then bending the heated portions to form an offset throw section. However, the apparatus illustrated therein is limited to the formation of a crankshaft wherein all of the throws lie in a single plane, unless separate heating, forming and cooling cycles are carried out with some manual adjusting of the rotary positioning of the bar between the performance of such cycles. U.S. Pat. No. 4,030,172 discloses apparatus for forming multi-throw crankshafts from a metal rod in a one-shot, automatic operation regardless of the desired position of the respective throws at any location 360° about the axis thereof.

The crankshaft may have to be used in various applications, one of which is in farm equipment. Preferably, each of the throws is to be parallel, throughout its length, to the horizontal rotational axis defined by the ends of the crankshaft. Thus, a throw should not be high at one end or low at another end, relative the horizontal rotational axis for the crankshaft. Likewise, in a horizontal direction, one end of the throw should not be nearer to the horizontal rotational axis than the other end of the throw. High or low, as well as near or far ends on the throws, cause undue localized forces and/or wear which could be eliminated or reduced, if the throw had its axis and surfaces more perfectly parallel to the rotational axis of the crankshaft. The throws are formed while the bar is heated to a temperature of 1800° to 1900° and then the crankshaft is allowed to cool. Because of the substantial bending and the formation of corners where the throws join the rest of the crankshaft, differential cooling occurs and differential shrinking occurs, and the direction of shrinking pulls the throws from parallel alignment with the rotational axis. Also, apparatus disclosed in the aforementioned patent is used to make crankshafts of different lengths, different numbers of throws, and different angular positions of the throws with different diameters of rod. Hence, the differential shrinking and pulling in different directions, and the adjustments for different numbers of throws and sizes of rods, makes it difficult to keep the precise alignment of parallelism for each of the throws with respect to the rotational axis. Thus, there is a need for the ability, in such a crankshaft forming machine, to be able to make adjustments and corrections to assure the desired parallelism for each of the throws irrespective of the cause of such non-parallelism.

The crankshafts are bent with forming heads that move axially as the throws are made and the crankshaft is shortened, and the forming heads include carriages and subcarriages movable in directions orthogonal to one another, so as to displace the throw at a predetermined angle about a spectrum of 360°. Thus, the crankshaft may have throws at 15° or 195° etc. about the rotational axis. All of these complex and simultaneous movements are controlled, but with the variables and tolerances involved, it is not unexpected that the throws might not be in exact parallelism from one end to the other end thereof. The ability to make such adjustments should not be so difficult or cumbersome that the operator cannot make the adjustments with reasonable speed and understanding of how the adjustments are made. Moreover, the adjustments are made with relatively simple and inexpensive mechanisms that can withstand the heat and high forces involved in bending the crankshafts.

Another aspect of the apparatus disclosed in U.S. Pat. No. 4,030,172 that could stand improvement, is the manner of clamping and opening and closing the split halves of the forming heads which grip the rod at the locations the throws are to be made. It has been found that more uniform electrical heating of the rod is achieved at the throws, if the clamping pressure is increased. With the pivoted heads disclosed in this patent, the upper head is held closed by a pair of locking pins inserted into a pair of holes in a tongue attached to the upper head. There is no adjustment of this clamping force and of course, locking bolts and holes may wear out with continued use, causing a decrease in clamping force. Decreased clamping force appears to allow more localized spots of differential heating which can be reduced with higher clamping forces. The prior opening mechanism for pivoting upwardly the upper half of the forming head, as disclosed in U.S. Pat. No. 4,030,172, included a slide bar which moved a cam that cammed against an ear on the upper half. Such camming experienced a high degree of wear. Thus, there is a need to provide a new and improved manner of opening and closing the forming heads, and in applying large clamping forces to the rod to overcome localized heating areas on the clamped portions of the rod.

SUMMARY OF THE INVENTION

This invention will be more fully understood and further objects and advantages thereof will become apparent in the following detailed description of preferred embodiments of the invention illustrated in the accompanying drawings:

DETAILED DESCRIPTION OF THE PREFERRED EMBODIMENT

Figure 1:
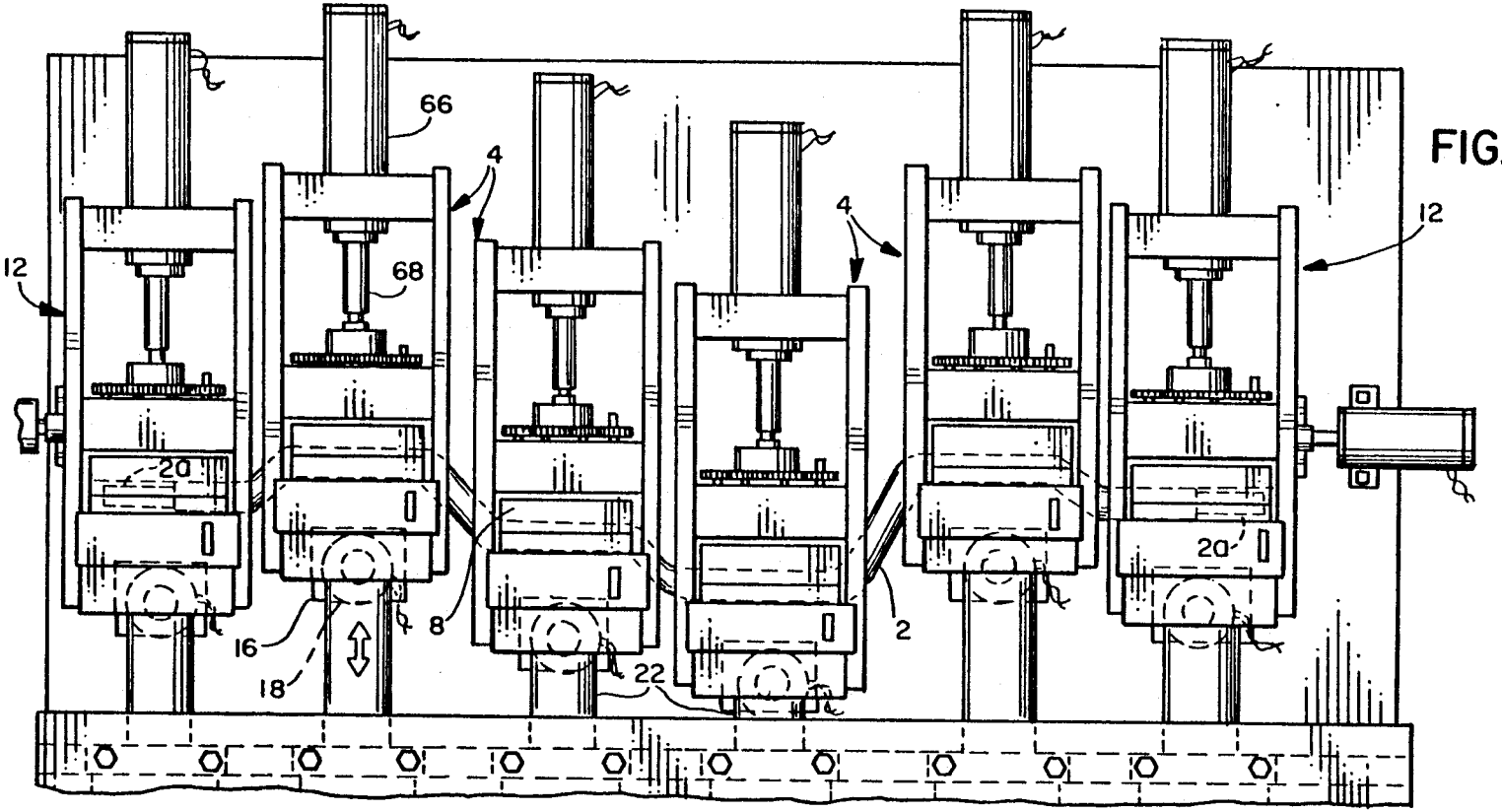
FIG. 1 is a plan view of a crankshaft-forming apparatus constructed according to principles of the present invention, particularly pointing out the plurality of forming units along the length of a rod.

As shown in the drawings for purposes of illustration, the invention is embodied in a crank forming apparatus which may be of the kind disclosed in U.S. Pat. No. 4,030,172, which is hereby incorporated by reference as if fully reproduced herein. The apparatus for forming crankshafts or the like from metal rod 2, utilizes a plurality of forming units 4, which are designed to be automatically actuated by a control system to achieve the formation of a multiple throw crankshaft 6, on a one-shot basis. Referring to FIG. 1, a suitable length of metal rod 2 is electrically heated to its appropriate forming temperature, and a number of forming heads 8, equal to the number of desired throws 10, are clamped about the rod 2 at appropriate locations along its length. A pair of end holding forming units 12 function along with the other forming units 4, and move the ends 2*a* of the rod inward as the forming takes place, to prevent any necking-down or reduction in the cross-section of the rod as a result of its transverse deformation to create the throws. These end holding units 12 also define the rotational axis 14 of the crankshaft 6. The forming units 4 are individually movable, relative to one another, so that they will move closer to one another in a direction longitudinally along the axis of the rod 2 during the forming operation. The forming units 4 each include a subcarriage 16, which is attached to a piston or ram 18 of a horizontally mounted cylinder 20, which can displace the subcarriage 16 either forward or rearward, relative to the rotational axis 14 of the crankshaft 6. The subcarriage 16 carries the forming head 8, which is in turn attached to a depending, vertically disposed cylinder 22, which displaces the forming head 8, either upward or downward with regard to the axis 14 of the heated metal rod. Because each of the individual forming units 4 can be moved either upward or downward, and either rearward or forward, the simultaneous movement in two such directions, for example, upward and rearward, is available to create a crank throw 10 positioned at any angle, out of the 360° spectrum, about the axis 14 of the crankshaft.

Figure 2:
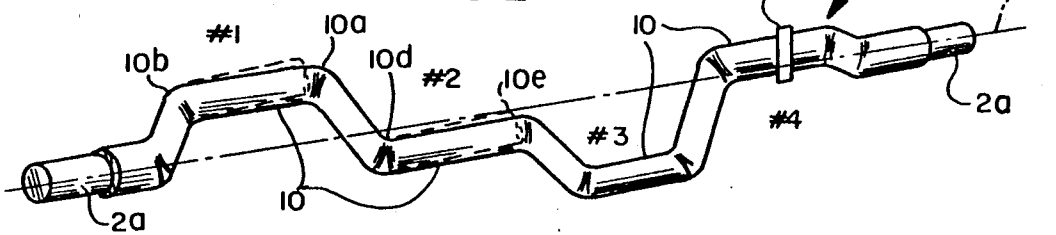
FIG. 2 is a perspective view of a crankshaft formed by the apparatus of FIG. 1, with dotted lines representing throw sections non-parallel with the rotational axis of the crankshaft.

Due to the differential cooling and shrinking of the newly-formed crankshaft and/or the multiplicity of variable, and simultaneous movements the apparatus must undergo, and the tolerances associated therewith, a crank throw 10 thus formed, might not be parallel from one end of the throw to the other, with the rotational axis 14 of the crankshaft 6. Referring to FIG. 2, the throws 10 formed may be askew such that in a first, vertical plane one end 10*a* of a throw is higher or lower than the other end 10*b* of that throw with respect to the rotational axis 14 of the crankshaft; or in a second, horizontal plane one end 10*c* of a throw 10, is more rearward or forward than than the other end 10*d*; or a combination of the two, such that one end of a throw is, say, more rearward and higher than the other end of that throw. It can be appreciated that a throw may be askew in more than one plane simultaneously; that is, one end of a throw may be both upward and rearward from the other end of that throw. The dotted lines shown in FIG. 2 are illustrative of throws which are not in parallel alignment with respect to the rotational axis 14. For instance, the dotted lines of throw #1 illustrate a throw 10, which is non-parallel in a vertical plane, with one end of the throw more upward than the other with respect to the rotational axis 14 of the crankshaft. Likewise, the dotted lines of throw #2 illustrate a throw 10 which is non-parallel in a horizontal plane, with one end of the throw higher than the other end, and one end 10*d* of the throw more offset from the rotational axis 14 of the crankshaft 6.

Another problem associated with the crank forming apparatus of U.S. Pat. No. 4,030,172, is the manner of clamping, as well as opening and closing of the forming heads 8, which grip the rod 2 at the locations the throws 10 are to be made. With the pivoted forming heads disclosed in that patent, the upper head is held closed by a pair of locking pins, inserted into a pair of holes in a tongue attached to the upper head. There is no adjustment of this clamping force and, of course, locking bolts and holes may wear out with continued use causing a decrease in clamping force. Low clamping force is a problem, in that it appears to allow more localized spots of differential heating which could be reduced with higher clamping forces. Additionally, due to the inevitable wear of the locking bolts and holes, an adjustable clamping force of some kind is necessary in order to compensate for this wear and maintain sufficient clamping force. The prior opening mechanism for upwardly pivoting the upper half 8*a* of the forming head, as disclosed in U.S. Pat. No. 4,030,172, included a slide bar which moved a cam that cammed against an ear on the upper half of the forming head. Such camming experienced a high degree of wear, resulting in the failure of the forming heads to open and close automatically. Thus, there is a need to provide a new and improved manner of opening and closing the forming heads 8, and in applying large clamping forces to the rod 2 to overcome localized heating areas on the clamped portions of the rod.

In accordance with the present invention, the position of the forming heads 8 may be easily adjusted to correct any non-parallelism. This is achieved by mounting the forming heads so that the ends of the heads may be moved in or out, relative to the horizontal axis 14 of the rod, until the throw 10 is parallel to the rotational axis 14. Simple adjusting means 26, preferably in the form of adjusting screws 28 through 31, have been provided which engage the forming head 8, with one pair of screws 28 and 30, for adjusting the position of the head 8 to turn ends of the head upwardly or downwardly, about a horizontal axis 57 (FIG. 3), and second pair of adjusting screws 32 and 34 for adjusting the position of the head, to turn the head to turn ends of the head inwardly or outwardly, in a horizontal direction about a vertical axis 56, to make the entire length of the throws 10 parallel to the rotational axis 14 of the crankshaft 6. By rotating the head 8 about the vertical axis 56, and the horizontal axis 57 which intersect at the rotational axis 14 (FIG. 3) of the rod 2, the head can be adjusted until the throw will be parallel to the longitudinal axis 14.

Adjusting screws 28, 30, 32 and 34, each have respective gears 28*a*, 30*a*, 32*a*, and 34*a* as their heads. Both pairs of screws 28, 30 and 32, 34 are connected together by gear trains, such that turning of an adjusting screw in one direction causes the other screw of that pair to turn in the opposite direction, an equal amount. For instance, referring to FIG. 3A, rotation of adjusting screw 30, in a clockwise direction, causes rotation of gear 30*a* integral therewith to rotate clockwise, and adjacent gear 36*d* to rotate counterclockwise, due to meshing of the gear teeth of these two adjacent gears 30*a* and 36*d*. The teeth of gear 36*d* in turn, mesh with the teeth of adjacent gear 36*c* causing gear 36*c* to rotate in a clockwise direction. Finally, the teeth of gear 36*c* mesh with the teeth of gear 28*a*, which is integral with adjusting screw 28, causing gear 28*a* and its associated adjusting screw 28 to rotate in a counterclockwise direction. Gears 28*a*, 30*a*, 36*c* and 36*d* are preferably of the same size, so that gear 28*a* rotates an amount equal to and opposite the rotation of gear 30*a*. This same gear train arrangement is employed with vertical adjusting screws 32 and 34, with gears 36*a* and 36 interconnecting the adjusting screws such that rotation of adjusting screw 32 in a clockwise direction, causes adjusting screw 34 to rotate an equal amount in the counterclockwise direction (see FIG. 3).

In order to open and close the forming heads 8, and to clamp the rod 2 tightly with a high degree of force, an actuator means having a toggle 38 has been devised, which exerts a high degree of force to the pivoted half 8*a* of the forming head. The toggle 38 has an adjustable link 86 which allows the clamping pressure to be increased as desired, to overcome localized heating problems due to insufficient clamping pressure. The toggle mechanism eliminates a cam and its associated wear by eliminating the above-mentioned sliding bar and associated ear on the forming head.

Figure 3A:
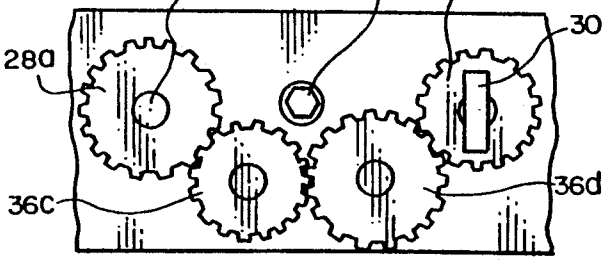
FIG. 3A is a fragmentary view of the general relationship of the adjusting screws.
Figure 3:
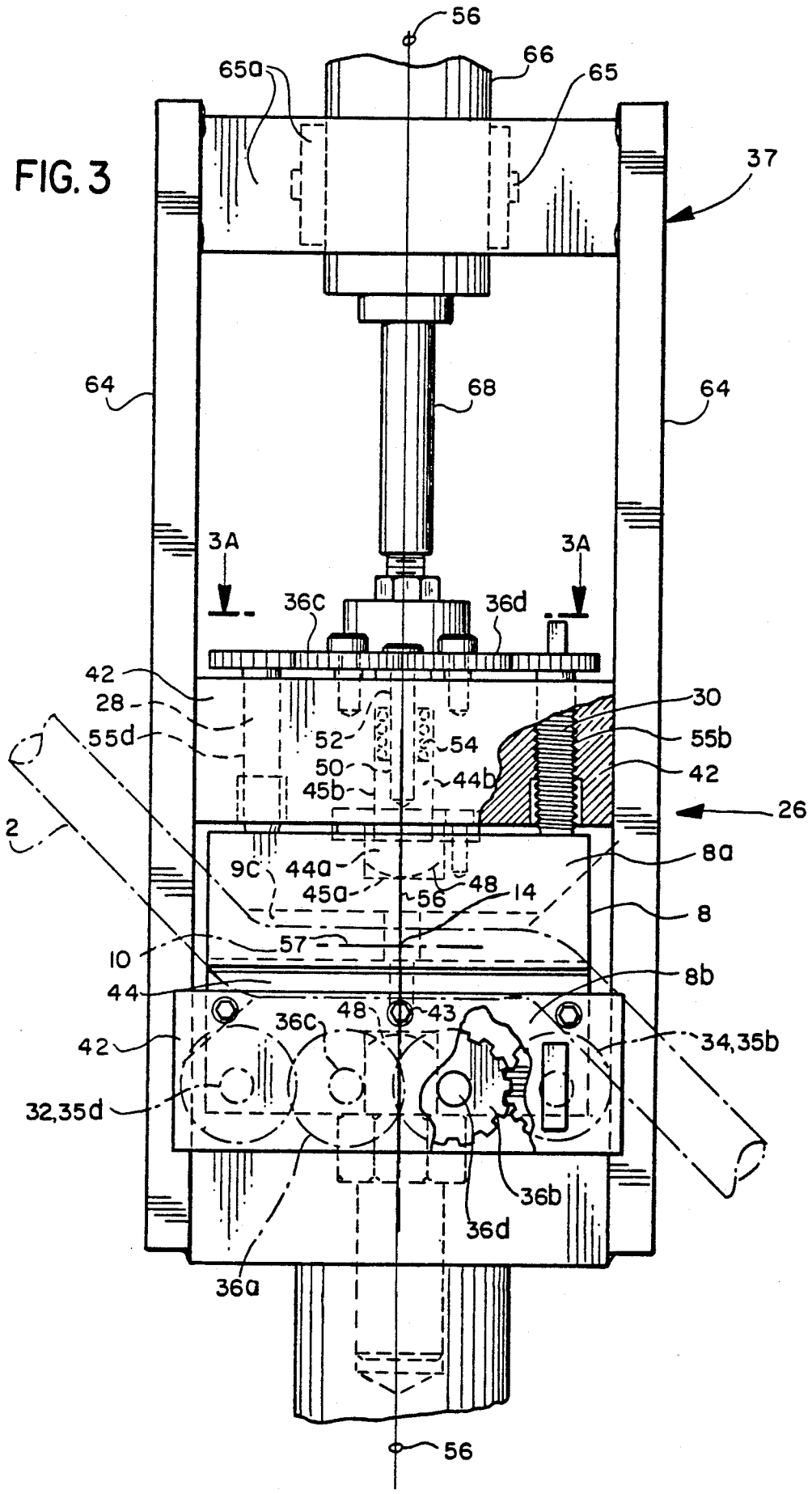
FIG. 3 is a front, elevational view of a forming unit particularly illustrating an embodiment of a means for adjusting the angular orientation of a throw section therein.

Turning now to a detailed description of the preferred embodiment, and in particular FIG. 3, the forming heads 8 are provided with an adjusting means 26 for adjusting the angular position of the clamping means, with respect to the rotational crankshaft axis 14. This is carried out by mounting the forming heads 8, so that they can pivot about both the first, vertical axis 56 as well as a second, horizontal axis 57, upon turning of actuator screws which are movable to pivot the forming head 8 about the first and second axes. In the preferred embodiment shown in FIG. 3, the forming head 8 has a first, upper half 8*a* and a second, lower half 8*b*. Each half 8*a* and 8*b* has respective hollow portions 9*a* and 9*b*, to accommodate hardened inserts 9*c* and 9*d*, which have respective semi-circular portions 41*a* and 41*b*, to accommodate a rod 2 therebetween (see FIG. 5). Hardened inserts 9*c* and 9*d* are removable, so that inserts having various sized semi-circular portions 41*a* and 41*b* can be utilized, depending upon the diameter of the rod 2 to be formed therein. Hardened inserts 9*c* and 9*d* also allow replacement of worn semi-circular portions 41*a* and 41*b*, without the need to install an entire new forming head 8. The inserts 9*c* and 9*d* also preferably include a semi-circular ring pocket 43 for receiving a locating ring 49 for locating the bearing (not shown). The ring 49 is located at the center of the length of each throw 10. In a subsequent operation, on another machine, rings 49 are squeezed and hydraulically embedded into the crankshaft 6. These rings 49 serve as bearing locators to prevent the split bearings (not shown) located on each throw 10, which support the crankshaft 6, from shifting along the throw sections 10.

Referring to FIG. 3, rocker bearings 44 and 46 are disposed in the first and second halves, 8*a* and 8*b*, of the forming head 8, respectively, and are centered on the vertical axis 56, such that the forming head 8 can rock on these bearings 46 and 48 about the horizontal axis 57 to raise one side, for example, to the right hand side of the head, while lowering the left hand end of the head. The rocker bearing 44 is disposed in the first half of the forming head 8, the rocker bearing having a rounded head portion 44*a* and a shank portion 44*b*. The head 44*a* is disposed in a head bore 45*a*, in the upper half 8*a* of the forming head 8, which extends part way into the first half 8*a* of the forming head. The shank 44*b* extends upwardly therefrom into a rocker bore 45*b*, which extends part way into an adjusting bracket 42. The shank 44*b* has a threaded bore 50 therein concentric with its central axis. A threaded member 52 extends through the adjusting bracket 110 and into the rocker bore 45*b* at the end thereof opposite the end at which the shank 44*b* enters the bore. Threaded member 52 extends into shank 44*b* and is threadably engaged thereto, so that the distance of the head 44*a* from the rod 2 can be adjusted. There is also preferably a spring 54 which is disposed about the threaded member 52, which abuts the bearing 44, thereby biasing rocker bearing 44 toward the rod 2. This arrangement allows the forming head 8 to be essentially free-floating in the first plane. The upper half 8*a* is connected to the pivotal mounted block 42, and is lifted by the latter as it pivots up to the open position shown in FIG. 5, by interengagement of a horizontal shoulder 44*d* on the rocker bearing 44, and a connecting block 42*d* on the block 42. More specifically, the block 42*d* is located centrally on the vertical axis and has a central aperture therein, sized to let the shank portion 44*b* of the rocker bearing pass through the aperture. The lower side of connecting block 42*d* abuts the annular shoulder 44*d* formed between the enlarged head portion 44*a* and the shank portion 44*b* on the rocker bearing. The connecting block is fastened by bolts 44*f* to the upper side of the upper half 8*a* to confine the larger diameter head portion below the connecting block. Thus, the head portion 44*a* is captured beneath the connecting block while the shank portion 44*b* projects through the aperture and is fastened by the bolt 52 to the upper end of the block 42. When the block 42 pivots upwardly, the bolt 52 pulls the shank 44*b* upwardly to abut the annular shoulder 44*d* against the underside of the connecting block 42*d* and exerts a pull on the connecting block in an upwardly direction; and because the connecting block 42*d* is bolted by bolts 44*f* to the upper half, the upper half is also pulled upwardly. When the upper half 8*a* is lowered to the position in FIG. 3, the enlarged head pushes down on the upper half at the curved lower surface 48, which abuts the bottom surface of the socket 45*a*. The spring 54 pushes down on the top of the rocker 44 to impart a bias to the rocker to push it down against the bottom wall in the rocker socket 45*a*. The spring 54 biases the shank portion 44*b* and the rocker head portion downwardly to abut the latter with the bottom of the enlarged rocker head. This spring force is used during the initial portion of the system until the rod is heated to 1800°-1900° F. During the last few seconds of the bending of rod, the fluid pressure is increased and higher pressure fluid is used to force the screws 28 and 30 to become more effective to push the top block half 8*a* more tightly against the rod, and to rock the upper half about the rocker bearing and the horizontal axis. Thus, at final high pressure, the screws 28 and 30 exert high level forces, to push the upper half 8*a* down tightly with the upper half 8*a* rocking about the rocker curved end surface 48.

Referring briefly to FIG. 3, vertical adjusting screws 28 and 30 having threaded shafts, are threadably engaged with, and extend through, threaded bores 55*a* and 55*b* in adjusting bracket 42. Threaded bores 55*a* and 55*b* are positioned on opposite sides of rocker bearings 44, and are located at equal distances from the vertical axis 56. The leading ends of vertical adjusting screws 28 and 30 extend below adjusting bracket 42 and abut the first half of the forming head 8*a*. The heights of the adjusting screws 28 and 30, relative to one another (up or down as viewed in FIG. 3), and the abutment of the forming head with these screws, thereby defines the angular position of the forming head 8 in the first plane. These vertical adjusting screws 28 and 30 are interconnected by gears 36*c* and 36*d* as shown in FIG. 3A, such that rotation of one vertical adjusting screw causes an equal and opposite rotation of the other vertical adjusting screw, thereby simplifying adjustments for an operator. The upper and lower halves 8*a* and 8*b* of the forming heads have complementary mating surfaces 8*c* and 8*d*, respectively, on the sides thereof which contact the rod, and because the upper and lower bearings 46 and 48 operate identically, an adjustment of the angular position of the upper half 8*a* of the head adjusts the lower half 8*b* of the head as well. Therefore, though adjustment of the angular position of the entire forming head 8 about the horizontal axis 57, is carried out by adjusting screws 28 and 30, engaging only the upper half 8*a* of the head, the angular position of the lower half 8*b* about the horizontal axis 57 is adjusted as well. As will be explained, adjusting the angular position of the lower half 8*b*, about the vertical axis 56, will adjust the upper half 8*a* about the vertical axis as well.

Figure 4:
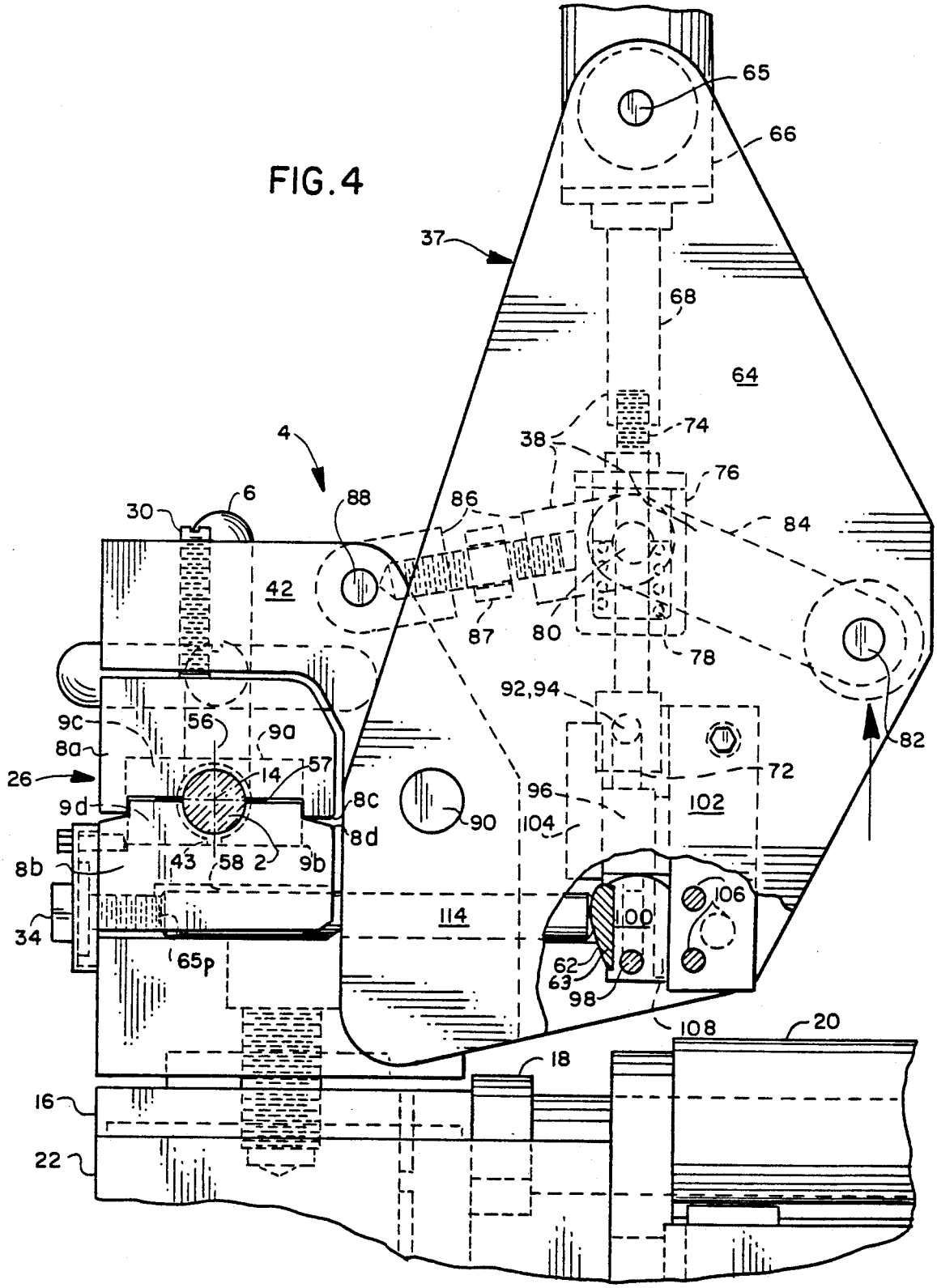
FIG. 4 is a side, elevational view of a forming unit, particularly showing the toggle mechanism in the closed position.
Figure 5:
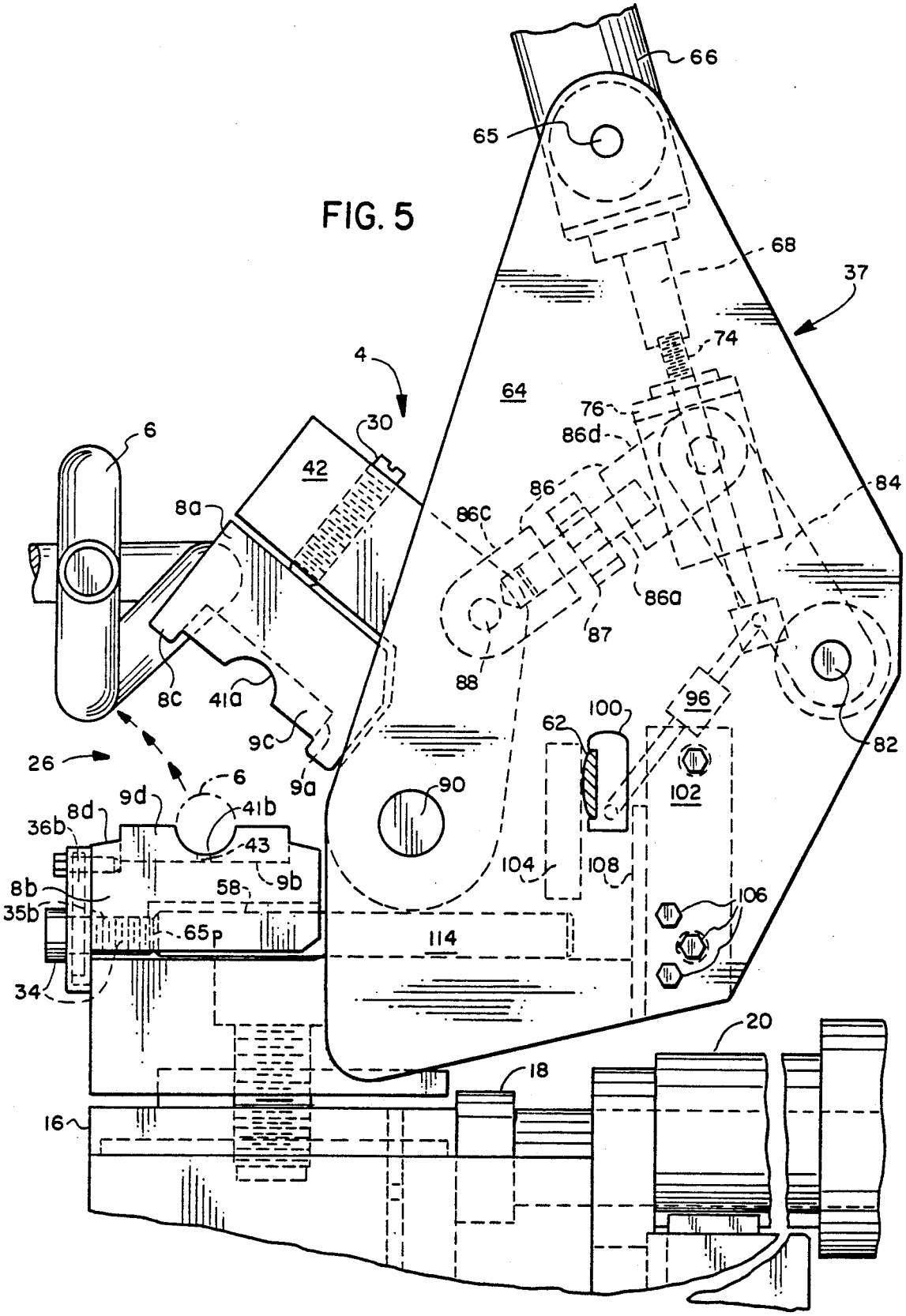
FIG. 5 is a side, elevational view of a forming unit as shown in FIG. 4, but with the toggle mechanism in the open position.
Figure 6:
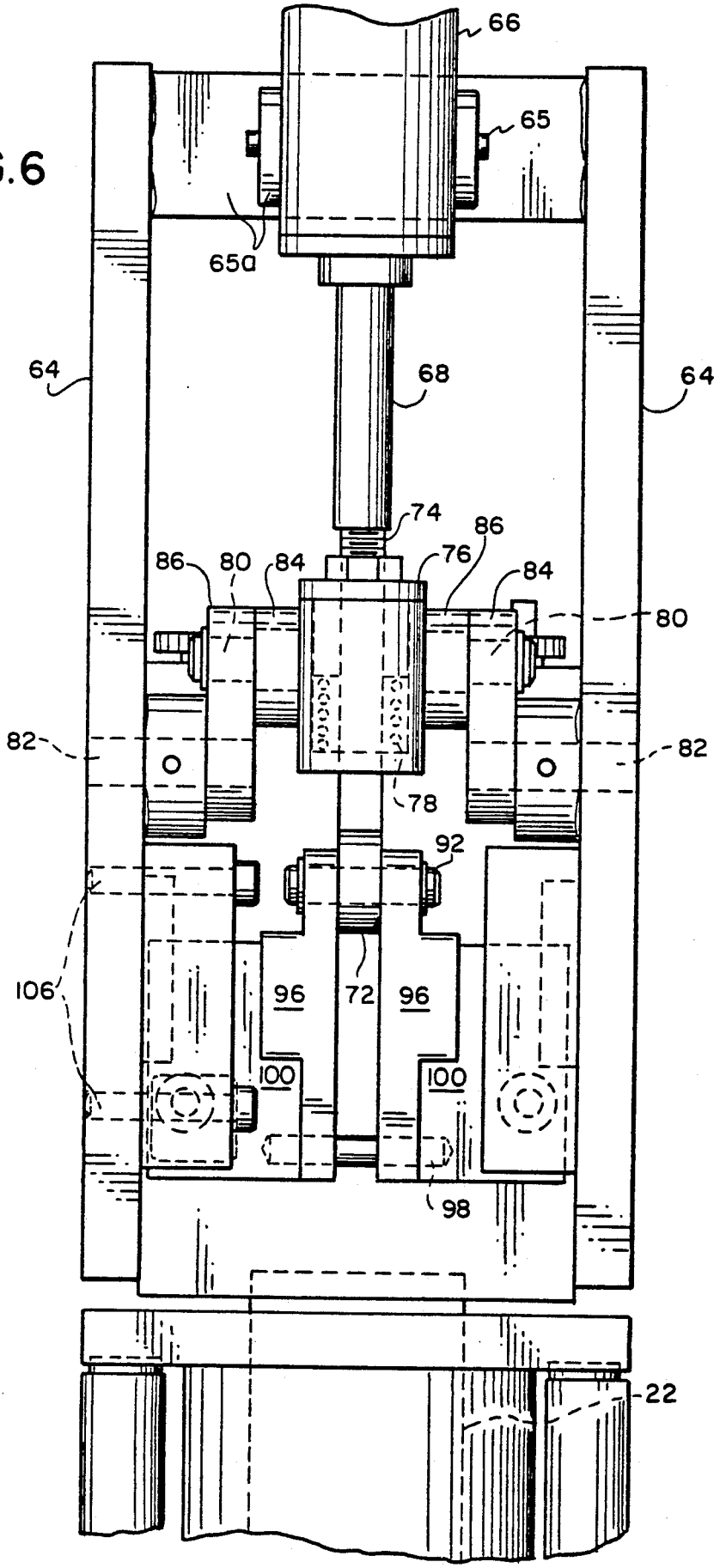
FIG. 6 is a rear, elevational view of the toggle mechanism.

Adjustment of the angular position of the forming heads 8 in a second plane, which is perpendicular to the first plane and about the vertical axis 56 of FIG. 3, is preferably carried out by horizontal adjusting screws 32 and 34 disposed in the second, lower half 8*b* of the forming head. Referring to FIGS. 3, 4 and 5, the lower half of the forming head 8*b* is basically free floating, and has a recess portion 58 in the side thereof opposite the rod engaging side. As seen in FIGS. 4 and 5, horizontal adjusting screws 32 and 34, having threaded shafts, are threadably engaged with, and extend through, threaded bores 35*a* and 35*b*, respectively, in the lower half 8*b* of the forming head extending to the recess portion 58. With brief reference to FIG. 3, the horizontal adjusting screws 32 and 34 are located at equal distances from the vertical axis, and on opposite ends of the lower half 8*b* of the forming head, and like the vertical adjusting screws 28 and 30, are interconnected by gears such that rotation of one screw induces an equal and opposite rotation of the other screw. Gears 36*a* and 36*b* are mounted for rotation on stub shafts 36*b* and 36*d* (FIG. 3). Referring again to FIGS. 4 and 5, a pair of push rods 60 extend into the recessed portion 58, and with left ends (FIG. 5) abutting the horizontal adjusting screws 32 and 34. The right ends of the push rods 60 abut a camming surface 62 on cams 63 which impart an axial force to the push rods 60, in the direction of the horizontal adjusting screws 32 and 34. The push rods and cams 63 define a first fixed length for pivoting the head about the vertical axis. The length that the screw shaft end 65, (FIG. 4) extends into the recess can be varied with the turning of the respective screws 32 and 34, to adjust the pivoting of the clamping head about the vertical axis 56. For instance, movement of the screw end 65, of the screw inwardly, as shown in FIG. 5, will cause the end shown in FIGS. 4 and 5 to move to the left about the vertical axis, when the camming surface 62 abuts the right end of the push rod and the push rod is forced to its previous position, but because the screw end 65, projects further inward, the push rods force the entire head to rock about the upper and lower bearings 46 and 48. At the other side of the head, the screw 32 will have rotated its shaft end outwardly, allowing its end of the clamp head to turn inwardly about the vertical axis 56. Thus, in this embodiment, the abutment of the camming surface 62, push rod 60, and horizontal adjusting screws 32 and 34 act to define the angular position of the forming head 8 in the second plane.

In order to both open and close the forming heads 8, as well as exert a force on the first, upper half 8*a* of the forming heads to tightly clamp the heated metal rod 2 between the first and second halves 8*a* and 8*b* of the forming heads, an actuating means 37, including a toggle 38 is utilized. The toggle 38 provides a clamping force for clamping the rod 2 tightly. Furthermore, the toggle 38 includes means for adjusting the clamping force, being imparted by the toggle, to the forming head 8. In the embodiment depicted in FIGS. 3 through 6, the actuator means 37 includes two generally parallel side plates 64, which support the working components of the actuator means 37. A hydraulic cylinder 66 is pivotally mounted on a cylinder pivot pin 65 on a bracket 65*a* which extends between the two side plates 64. Hydraulic cylinder 66 is preferably used to actuate the toggle 38 and move it between its closed and open positions shown in FIGS. 4 and 5, respectively. The hydraulic cylinder 66 displaces a cylinder rod 68, having a proximal end 70 and a distal end 72. A threaded portion 74 is provided on the cylinder rod 68 which threadably engages a central block 76, with the distal end 72 of the cylinder rod extending through the central block 76. This extending portion of the cylinder rod 68 will be discussed further, below. Central block 76 preferably contains a spring 78 (FIG. 4), disposed therein for cushioning any impacts imparted axially to the cylinder rod 67. Central block 76 is preferably cylindrical with a pair of pivot pins 80 extending from diametrically opposed sides thereof. A second pair of pivot pins 82 extend inwardly from the side plates 64. Referring to FIGS. 4 and 5, a pair of generally parallel fixed-length link members 84 connect the first and second pivot pins 80 and 82, so as to maintain a fixed distance between the central block 76 and the second pair of pivot pins 82. A pair of adjustable-length link members 86 are pivotally attached at one end to the pivot pins 80 on the central block 76, and at their other end to pins 88 on block 42, which carries the upper half 8*a* of the forming head 8. The forming heads 8 preferably have water circulated therethrough, or the like, to keep the heads 8*a* and 8*b* cool. The block 42 is pivotal by pivoting pins 90 to the plates 64, for pivoting about a horizontal axis, to raise and lower the upper half 8*a* of the forming head. Thus, with reference to the views of FIGS. 4 and 5, in order to pivot the clamping head from the closed position of FIG. 4 to the open position of FIG. 5, the cylinder rod 68 is withdrawn into hydraulic cylinder 66 and the central block 76 is raised upward. This causes link 84 to pivot clockwise and adjustable link 86 to pivot counterclockwise, thereby bringing the pin 88 of block 42 nearer pivot pin 82. This arrangement of linkages causes the upper half 8*a* of the forming head to pivot about an axis through pivot pins 90 as it raises and lowers, between open and closed positions, as the hydraulic cylinder 66 displaces the central block 76 (see FIGS. 4 and 5).

In addition, increased fluid pressure in the hydraulic cylinder 66 imparts a proportionately greater force on the clamping block 42, resulting in greater clamping force on a rod 2 inserted between the upper and lower halve 8*a* and 8*b* of the forming heads 8. The toggle attains a highly increased mechanical advantage as the angle between the two link members 84 and 86 increases, and the links approach a straight-line configuration. The adjustable-length link members 86 allow the clamping force, exerted by the clamping arm 90, to be varied as desired by changing the angle between the two links 84 and 86 when they are in their closed positions. The length of the adjustable-length link 86 can be increased or decreased by turning adjusting nut 87, fixed to a threaded screw 86*a*, which has its opposite ends threaded into spaced halves 86*b* and 86*c* of the link, and the effective screw length between these halves may be shortened or lengthened, thus, the upper half 8*a* of the head may be moved closer or farther from the lower half 8*b* (see FIG. 4), to respectively increase or decrease the clamping force imparted by the forming heads 8 to the rod 2 being gripped by the split halves of the head.

The simultaneous horizontal adjusting force to the lower half 8*b* of the forming head, discussed above, is carried out by the distal end 72 of the cylinder rod 68, which extends through the central block 76 as discussed above. A first connecting pin 92 (FIG. 4), extends through the aperture 94 in the cylinder rod 68 and pivotally connects a pair of mounting blocks 96 to the cylinder rod. A second connecting pin 98 pivotally connects a pair of vertically slidable camming blocks 100 to the mounting blocks 98. The camming blocks 100 have curved camming surfaces 62 mounted thereon. The camming surface 62 has a lower tapered end and an increasing width, and the left end of the push rod has a complementary curved surface to be engaged by the curved camming surface for smooth and continuously camming action, when these surfaces abut and slide relative to one another. Downward force on the central block 76 or cylinder rod 68, results in downward movement of the camming surfaces 62. The mounting blocks 96 and camming blocks 100 are confined to vertical movement by a pair of stationary block members 102, abutting the mounting and camming block members 96 and 100 on one side, and a pair of guide block members 104 abutting them on the opposite side. The stationary blocks 102 and guide blocks 104 are attached to, and extend inwardly from, the side walls 64. The stationary block member 102 preferably contains reinforcing pins 106, connecting the stationary block 102 to the side wall 64, for providing additional holding strength to the stationary block member 102. Also, the side of the stationary block 102, facing the horizontal adjusting screws 32 and 34, preferably contains plastic bearings 108 or the like to reduce resistance to vertical translation of the mounting block 96 and camming block 100.

The operation of a machine, constructed according to principles of the present invention, will now be discussed through one cycle of operation. With the heads 8 pivoted to their open position, the upper halves 8*a* of the forming heads 8 are raised as shown in FIG. 5. The forming heads 8 are aligned in a straight line, and a straight metal rod is laid across the recesses 110 into engagement with the upwardly opened surfaces 41*b*, on the inserts 9*d* in the lower halves 8*b* of the forming heads. The fluid pressure in the hydraulic cylinder 66 is then increased, resulting in the downward displacement of the cylinder rod 68, which in turn downwardly displaces the central block 76 of the toggle, to cause the toggle arm links 84 and 86, at their inner ends at pivot pins 80, to move down with the adjustable link 86 swinging the upper half 8*a* down about the pivot pins 90. This imparts an initial downward clamping pressure to the head 42, which clamps the two forming head halves 8*a* and 8*b* together about the rod 2 inserted therebetween. This initial hydraulic cylinder pressure is preferably between 200 psi. and 400 psi., and is exerted upon the rod during the heating thereof. After the rod 2 has been heated to a temperature sufficient to permit its deformation, a heat sensing mechanism preferably in the form of an infrared sensor 120 (FIG. 2) pointed upwardly from below the rod, senses the color of the rod when it reaches the desired temperature, e.g., 1900° F. The sensor is located out of the smoke and heat (except for some radiation) and causes the high pressure application of hydraulic fluid into the actuator cylinder 66. The straight rod and the initial 200 psi pressure locate the upper and lower halves 8*a* and 8*b* substantially at their final positions; but it is the final pressure of 1000 to 1400 psi in the actuator cylinder, that causes the final adjustments and rocking of the halves 8*a* and 8*b* about the respective horizontal and vertical axis 57 and 56, respectively.

Stated differently, the infrared sensor 120 senses the rod 2 has been heated sufficiently and triggers a pump which increases the hydraulic cylinder pressure for the forming stage. The pressure in the hydraulic cylinder 66 is preferably increased to between 1,000 psi. and 1400 psi., and most preferably 1,200 psi. After the rod has been heated to the desired temperature, the increased pressure also moves the toggle downwardly through a further displacement of about 0.030 inch, in this embodiment of the invention, to further increase the clamping force on the rod at the time of rod deformation.

With reference to FIGS. 4 and 5, the above-mentioned downward movement of the central block 76 simultaneously pushes the camming surfaces 62 downwardly to impart an axial force to the push rods 114 abutting the camming surfaces 62. The axial force from the push rods 114 is applied to the horizontal adjusting screws 32 and 34, to rock the lower half 8*b* about the vertical axis 56 through bearings 46 and 48 to adjust the angular position of the forming head 8 about the vertical axis 56. The above-mentioned simultaneous downward pressure on the block 42, causes the ends of the screws 28 and 30 to rock the upper half 8*a* and lower half 8*b*, about the horizontal pivot axis 57 on the bearings 46 and 48. Thus, regardless of the position to which a forming unit 4 is moved in the 360° spectrum about the axis 14 of the crankshaft, the angular position of each forming head 8 can be independently adjusted by a simple means.

The forming heads 8 are moved to their desired positions to form the throw sections 10, after which the hydraulic cylinder 66 retracts the cylinder rod 68 and actuates the toggle 38, thereby simultaneously raising the block 42 with its attached forming head upper half 8*a*, to open the forming heads 8, and raising the camming surfaces 62 to eliminate the axial force in the push rods 114. The crankshaft 6, thus formed, is allowed to cool. Then the crankshaft 6 is scanned, preferably using a computerized crankshaft inspection apparatus such as that of U.S. Pat. No. 4,517,717, to determine if any throw sections 10 are non-parallel with the rotational axis 14 of the crankshaft. Adjustments to the corresponding adjusting screws 28 through 34, of the non-parallel throw sections 10, are then made as needed, and the operation repeated, until crankshafts 6 are formed having throw sections 10 parallel to the rotational axis 14 of the crankshaft. Typical adjustments are as small as 0.015 inch.

What is claimed is:

1. An apparatus for forming multiple throws in a crankshaft from a metal rod having a longitudinal axis, comprising:

a pair of holding units for holding ends of the metal rod at locations near the rod ends;

means for moving the holding units axially as the axial distance between the rod ends is shortened as the throws are formed;

means for heating the metal rod to a temperature sufficient to permit its deformation;

a plurality of forming heads having clamping means for clamping said metal rod at precise locations therealong between said holding units;

bearing means for mounting the heads for pivoting about a first central axis and for pivoting about a second axis perpendicular to the central axis;

means for independently moving the forming heads both axially and transversely to the longitudinal axis in any direction 360° thereabout; and adjusting means for adjusting the angular position of the clamping means with respect to the longitudinal axis so that the throws formed by the forming heads are aligned parallel to the longitudinal axis, including means for pivoting the forming heads on the bearing means about the central axis and the second axis.

2. An apparatus in accordance with claim 1 in which the bearing means includes a centrally located bearing located on the central axis which pivotally mounts the forming heads, and in which the means for pivoting the forming heads includes actuators which pivot the forming heads about the central axis.

3. An apparatus in accordance with claim 2 in which the actuators comprise movable members working in opposition and through equal distances on opposite sides of the central axis.

4. An apparatus in accordance with claim 3 in which the actuators comprise a pair of elongated screws and in which gears interconnect the screws so that turning of one screw in one direction drives the other screw through an equal movement in the opposite direction.

5. An apparatus for forming multiple throws on a heated metal rod having a longitudinal axis to form a crankshaft, said apparatus comprising:

a frame means;

means for heating the rod;

means on the frame means for mounting the rod to allow the axial distance between ends of the rod to shorten as throws are made in the rod at locations displaced from a central turning axis;

a plurality of forming heads mounted on the frame means for clamping portions of the rod and for moving said portion of the rod in directions transverse to the longitudinal axis and at different angles about the rod;

a first portion of each of the plurality of forming heads movable between an open position allowing the metal rod to be inserted into or removed from the plurality of forming heads and a closed position for clamping the metal rod during electrical heating with a clamping force; and an actuator means including a toggle means for pivoting the first portion between the open and closed positions with the toggle means exerting a force on the first portion to tightly clamp the heated metal rod when the first portion is in the closed position, said actuator means including an adjustable means for adjusting the force being imparted by the toggle means to the forming heads including an extendable link which can be lengthened or shortened to change a displacement of the first portion of the head and thereby change the clamping force on the heated metal rod.

6. An apparatus in accordance with claim 5 in which the actuator means comprises a fluid cylinder means for moving the toggle means to a first position at low fluid pressure during an initial heating of the metal rod, said fluid cylinder means being operable at higher fluid pressure to displace the toggle further and to increase the clamping force on the rod during a deformation of the metal rod.

7. An apparatus for forming multiple throws on a heated metal rod having two ends and a longitudinal axis to form a crankshaft, said apparatus comprising:

a frame means;

means for heating the rod;

means on the frame means for mounting the rod to allow the axial distance between the rod ends to shorten as throws are made therein at locations displaced from a central turning axis;

a plurality of forming heads mounted on the frame means for clamping portions of the rod and for moving indirection transverse to the longitudinal axis and at different angles about the rod;

a first portion of each of the plurality of forming heads movable between an open position allowing the metal rod to be inserted into or removed from the plurality of forming heads and a closed position for clamping the metal rod during electrical heating with a clamping force;

means for moveably mounting a second portion of the plurality of forming heads on the frame means; and an actuator means including a toggle means for pivoting the first portion between the open and closed positions with the toggle means exerting a force on the first portion to tightly clamp the heated metal rod when the first portion is in the closed position, the actuator means further including cam means for camming the second portion to clamp the rod more tightly as the toggle means pivots the first portion to tightly clamp the metal rod.

8. An apparatus in accordance with claim 7 in which the cam means comprises a pair of spaced members on the second portion and a pair of movable cam members connected to the toggle means to be moved therewith to cam the spaced members and the second portion to tightly clamp the metal rod.

9. An apparatus in accordance with claim 8 in which the spaced members on the second portion are each movable in equal and opposite directions and an adjustment means moves the spaced members in equal and opposite directions to swing the forming head about a first axis to adjust the throw being made therein to be parallel to the central turning axis of the crankshaft.

10. An apparatus in accordance with claim 9 in which a second adjusting means moves the forming head about a second axis orthogonal to the first axis.

11. A method for forming multiple throws in a crankshaft, from a metal rod having the ends and a longitudinal rotational axis, comprising:

holding a metal rod to be formed near the ends thereof by a pair of end holding units;

heating said metal rod to a temperature sufficient to permit its deformation;

clamping said metal rod with clamping means at precise locations along its length between said end holding units;

pivotally mounting the clamping means for pivoting about the longitudinal rotational axis and for pivoting about a second axis perpendicular thereto;

forming throws in said metal rod by forcibly moving said clamping means independently in both an axial direction and in a direction transverse to the longitudinal rotational axis in any direction 360° thereabout;

moving the end holding units axially as the distance between the rod ends is shortened as the throws are being formed;

testing the throws, thereby determining if the throws are parallel to the longitudinal rotational axis; and adjusting an angular position of said clamping means with respect to said longitudinal rotational axis by pivoting the clamping means with respective pairs of actuators straddling each of the longitudinal and second axes, by working the actuators in each pair in opposition through equal distances on opposite sides of the respective axis they straddle thereby aligning the throws formed by said forming units parallel to said longitudinal rotational axis.

12. A method for forming multiple throws on a heated metal rod having two ends to form a crankshaft, comprising:

moving a first portion of each of a plurality of forming heads to an open position thereby allowing the metal rod to be inserted into the forming heads;

inserting the rod into the forming heads;

mounting the rod to allow an axial distance between the ends thereof to shorten as throws are made therein at locations displaced from a central turning axis;

actuating a toggle, thereby exerting a force on a first portion of each of said plurality of forming heads thereby clamping the forming heads about the metal rod while heating the metal rod to a temperature sufficient to permit its deformation;

adjusting the clamping force by lengthening or shortening an extendable link connected to the first portions of said plurality of forming heads thereby changing a displacement thereof and thereby adjusting the clamping force on the heated metal rod;

forming throws in said metal rod by forcibly moving said forming heads independently in both an axial direction and in a direction transverse to the central turning axis in any direction 360° thereabout; and moving the first portion of each of the plurality of forming heads to an open position thereby allowing the metal rod to be removed.

* * * * *

UNITED STATES PATENT AND TRADEMARK OFFICE

CERTIFICATE OF CORRECTION

PATENT NO. : 5,022,129

DATED : June 11, 1991

INVENTOR(S) : Elvin O. Gentry

It is certified that error appears in the above-identified patent and that said Letters Patent is hereby corrected as shown below:

IN THE CLAIMS:

In column 13, line 2 (Claim 11) change "the" to read --two--.

Signed and Sealed this

Twenty-ninth Day of December, 1992

*Attest:*

DOUGLAS B. COMER

*Attesting Officer*

*Acting Commissioner of Patents and Trademarks*